US008342641B2

(12) United States Patent
Pons et al.

(10) Patent No.: US 8,342,641 B2
(45) Date of Patent: Jan. 1, 2013

(54) INK SEPARATORS

(75) Inventors: Macia Solé Pons, Sant Quirze del Valles (ES); Xavier Gasso Puchal, Barcelona (ES); Marta Coma Vives, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 371 days.

(21) Appl. No.: 12/788,840

(22) Filed: May 27, 2010

(65) Prior Publication Data

US 2011/0292140 A1 Dec. 1, 2011

(51) Int. Cl.
*B41J 2/185* (2006.01)

(52) U.S. Cl. ..... 347/36

(58) Field of Classification Search ..... 347/36, 347/84, 85, 89, 90; 95/267, 272
See application file for complete search history.

(56) References Cited

U.S. PATENT DOCUMENTS

| | | | | |
|---|---|---|---|---|
| 6,419,343 | B1 | 7/2002 | Taylor et al. | |
| 6,513,904 | B1 | 2/2003 | Taylor et al. | |
| 6,561,621 | B2 | 5/2003 | Webster et al. | |
| 6,588,876 | B2 | 7/2003 | Taylor et al. | |
| 6,969,159 | B2 | 11/2005 | Su et al. | |
| 8,177,887 | B2 * | 5/2012 | Schmid et al. | 95/272 |
| 2009/0002438 | A1 | 1/2009 | Raz et al. | |
| 2009/0073219 | A1 | 3/2009 | Curcio et al. | |
| 2009/0114088 | A1 | 5/2009 | Evenstad et al. | |
| 2009/0222279 | A1 * | 9/2009 | Reiz | 705/1 |
| 2012/0105839 | A1 * | 5/2012 | Novosselov et al. | 356/301 |
| 2012/0174650 | A1 * | 7/2012 | Ariessohn et al. | 73/23.2 |

OTHER PUBLICATIONS

"HP Designjet Z6100-series Printers: High Productivity at High Image Quality," Hewlett-Packard Development Company, L.P., Mar. 2007, 8 pages.

* cited by examiner

*Primary Examiner* — Huan Tran

(57) ABSTRACT

Ink separators are described herein. One example ink separator is described, which includes an ink receptacle to receive ink aerosol particles, a surface within the ink receptacle to change a direction of an airflow entraining the ink aerosol particles and cause at least a portion of the ink aerosol particles to combine to form ink droplets on the surface, and a chamber adjacent the surface to receive the airflow including the ink droplets and at least some of the ink aerosol particles, wherein the chamber includes at least two flow paths to separate the airflow and the ink aerosol particles from the ink droplets by directing the airflow and the ink aerosol particles to an aerosol collection port and the ink droplets to an ink droplet collection port.

20 Claims, 9 Drawing Sheets

INK SEPARATORS

BACKGROUND

In inkjet printers, print nozzles expel ink droplets onto print media, which dry to form images. The print nozzles are prone to clogging or other performance-deteriorating problems. Thus, the print nozzles may be subjected to one or more servicing procedures, including spitting, wiping, and/or capping and priming. The servicing procedures generate waste ink, which is collected and discarded and/or recycled.

DETAILED DESCRIPTION

Figure 1:
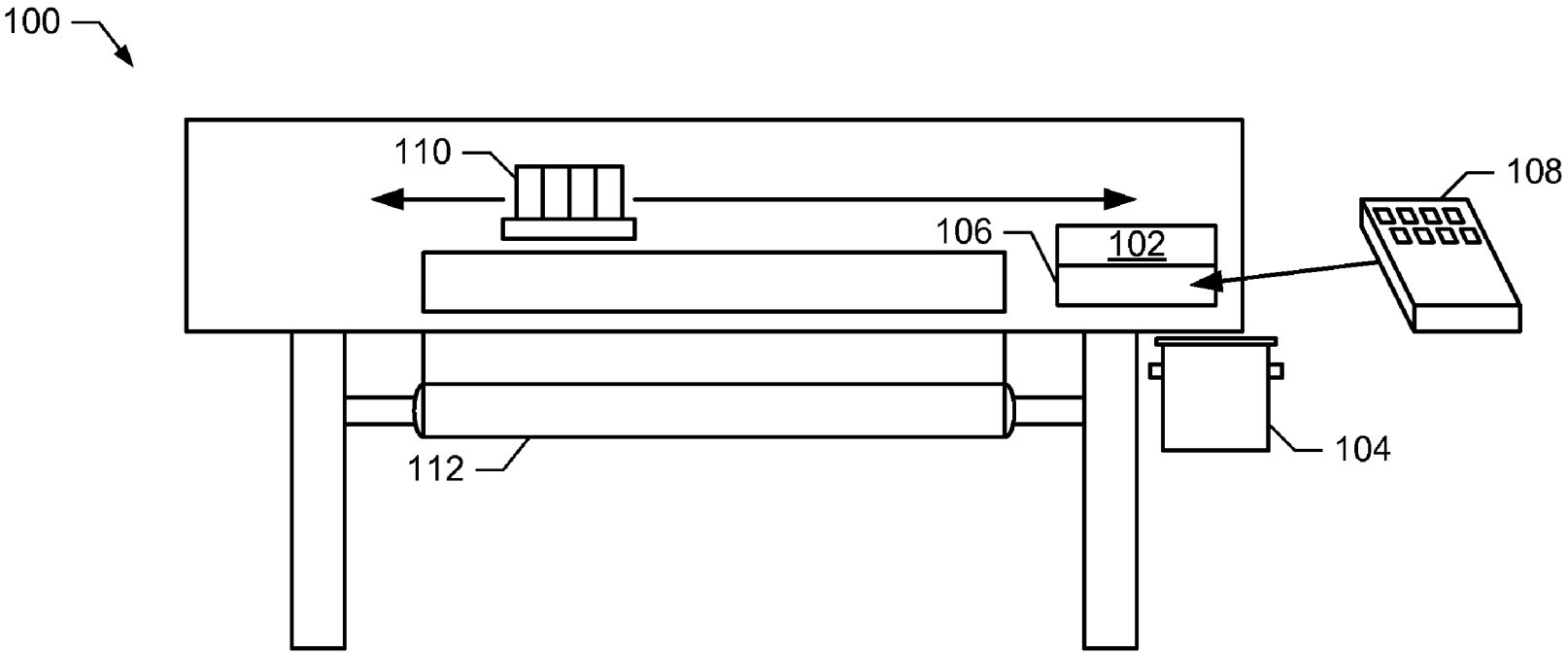
FIG. 1 is a printer including an example waste ink collection apparatus and a waste ink collection container constructed in accordance with the teachings described herein.

Certain examples are shown in the above-identified figures and described in detail below. Several examples are described throughout this specification. The figures are not necessarily to scale and certain features and certain views of the figures may be shown exaggerated in scale or in schematic for clarity and/or conciseness. Although the following discloses example methods and apparatus, it should be noted that such methods and apparatus are merely illustrative and should not be considered as limiting the scope of this disclosure.

The example methods and apparatus described herein may be used to collect waste ink resulting from printer nozzle servicing procedures. In some examples, nozzle servicing procedures, such as spitting, result in the production of ink aerosol particles having different sizes. As used in this document, the term "aerosol" means a suspension of small liquid and/or solid particles in a gas and the phrase "aerosol particles" means the small liquid and/or solid particles suspended or entrained in the gas. These ink aerosol particles are ejected, for example, from the printer nozzle into an aerosol receptacle.

In some examples, a vacuum source generates a vacuum at the aerosol receptacle to cause the aerosol particles to enter the aerosol receptacle. The vacuum source draws the aerosol particles from the aerosol receptacle through a separator. The separator may include a tortuous flow path or channel (e.g., a flow path or channel having one or more relatively abrupt direction changes). Such a tortuous flow path or channel causes relatively larger or heavier aerosol particles to impact one or more surfaces adjacent the directional change(s) and to thereby collect or coalesce into ink droplets on these surfaces. In this manner, the separator employs inertial impaction and/or inertial separation to convert at least some of the ink aerosol particles from the aerosol flow into larger, liquid ink drops.

Continuing with the example, the ink droplets may continue to move together with the aerosol flow toward a branch in the flow path that is coupled to the vacuum source. As the aerosol flow reaches this branch, the relatively lighter ink aerosol particles are drawn into the branch by the vacuum source and the relatively heavier ink droplets, due to their mass and velocity and, thus, inertia, are not pulled into the branch by the vacuum source. In this manner, the ink droplets are separated from the aerosol flow and continue along a flow path leading to a waste ink collection container. The relatively lighter ink aerosol particles are carried along with the aerosol flow to a filter that is separate from the waste ink collection container.

Some example separators may be oriented such that gravity, in addition to the vacuum source, pulls the ink droplets through the separator and toward the waste ink collection container. However, in other examples, only the vacuum source may be used to draw the ink droplets through the separator. Further, while the examples described herein involve an inertial impactor or similar structure to cause ink aerosol particles to form into ink droplets and a divided flow path that causes the relatively heavier ink droplets to flow along one branch for collection and the relatively lighter ink aerosol particles to flow along another branch for separate collection, any number of stages of such inertial impaction and/or flow path branching may be used.

Known waste ink collection apparatus typically include waste ink storage within a consumable cartridge or assembly. When the waste ink storage becomes full, the consumable cartridge or assembly is replaced at a substantial cost. However, the waste ink storage in these known consumable cartridges or assemblies is typically filled prior to other consumable aspects of the cartridge or assembly.

In contrast to these known waste ink collection apparatus, the example waste ink collection apparatus described herein have waste ink collection containers separate from the waste ink collection apparatus. As a result, both the waste ink collection apparatus and the waste ink collection container may have longer useful lives because the waste ink collection container may be large and, thus, hold more waste ink and the waste ink collection apparatus is not constrained by waste ink storage. Additionally, the example separators described herein may be user-replaceable in case of ink buildup within the separators. As a result, the examples described herein reduce the maintenance costs associated with inkjet printers.

Some example waste ink collection containers described herein store waste ink collected by the waste ink collection apparatus. The waste ink collection containers may include a shell and a cover sealed to the shell. The cover includes an ink inlet that extends to a position within the shell such that the waste ink collection apparatus does not leak ink regardless of the orientation of the waste ink collection apparatus. In some examples, the waste ink collection apparatus further includes an absorbent material within the shell to absorb ink.

FIG. 1 is a printer 100 including an example waste ink collection apparatus 102 and a waste ink collection container 104. The example waste ink collection apparatus 102 includes a cartridge receptacle 106 into which a consumable print head cleaning cartridge 108 may be installed and/or removed. The example printer 100 further includes one or more print heads 110 to deliver ink(s) to a print substrate 112 in a predefined pattern by selectively releasing ink adjacent the print substrate 112 via a number of small nozzles.

In general, the example waste ink collection apparatus 102 and the print head cleaning cartridge 108 operate to clean and/or maintain the print head(s) 110. For example, the waste ink collection apparatus 102 may perform a spit operation, which causes the print head(s) 110 to attempt to spray ink from some or all of their nozzles. When a spit operation occurs, the print head(s) 110 expel waste ink in droplet and/or aerosol form. Thus, the printer 100 generally positions the print head(s) 110 adjacent the waste ink collection apparatus 102 to capture the waste ink and reduce or prevent contamination of other portions of the printer 100.

As described in more detail below, the example waste ink collection apparatus 102 collects the waste ink droplets and/or ink aerosol particles, causes at least a portion of the ink aerosol particles to form (e.g., combine or coalesce into) additional ink droplets, and directs the waste ink droplets into the waste ink collection container 104. To cause the ink aerosol particles to combine or coalesce into droplets, the example waste ink collection apparatus 102 accelerates the ink aerosol particles along a flow path having one or more relatively sharp turns or directional changes (e.g., a tortuous flow path), thereby causing sufficiently massive aerosol particles to collide with one or more surfaces or walls adjacent the directional changes. Any sufficiently massive ink aerosol particles that collide with a surface or wall may collect or coalesce into ink droplets on that surface or wall. Ink droplets contain more moisture than individual ink aerosol particles and are therefore less likely to dry out and clog a passageway prior to reaching the waste ink collection container 104.

Figure 2:
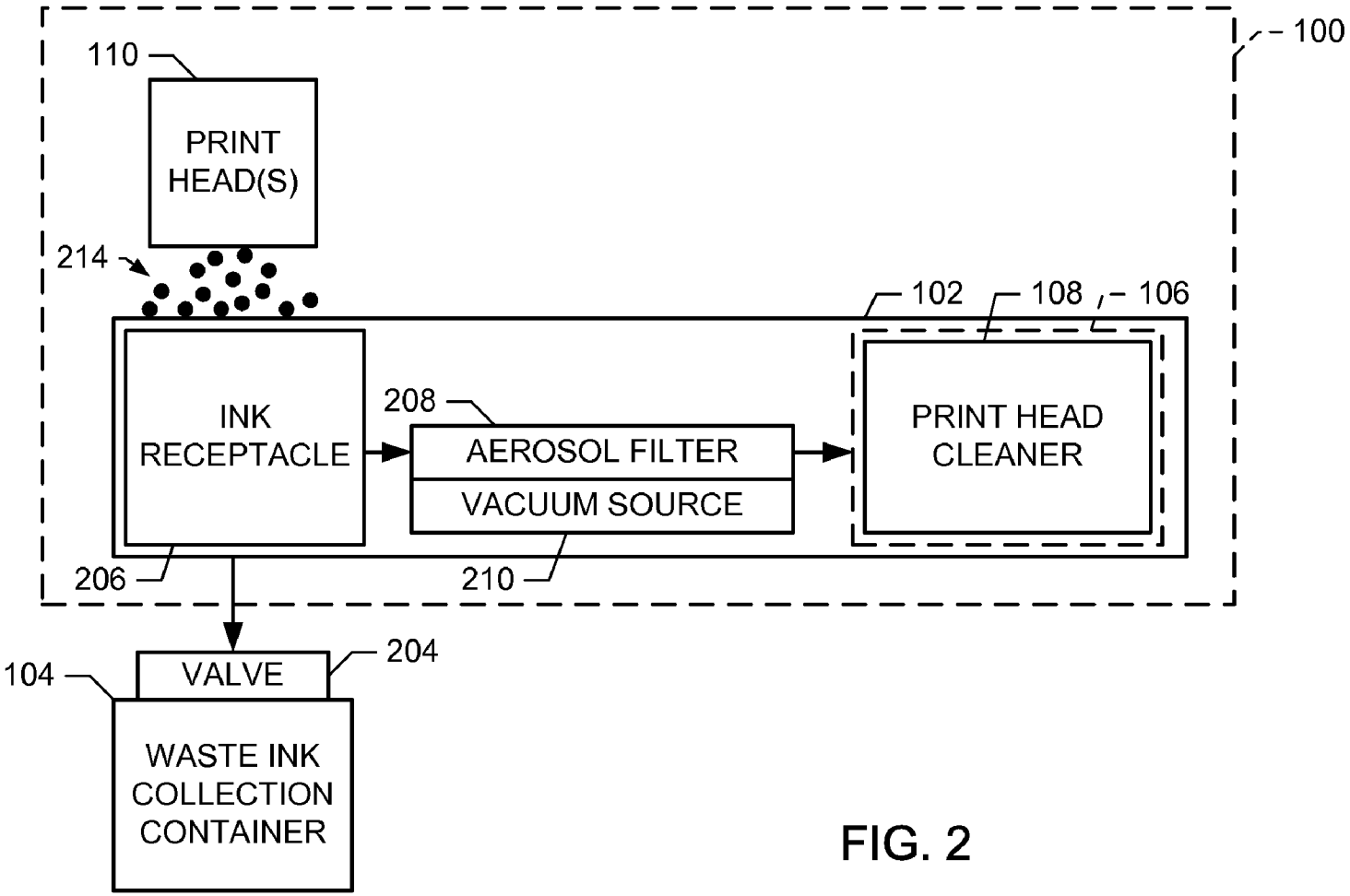
FIG. 2 is a block diagram of the example waste ink collection apparatus and waste ink collection container of FIG. 1.

FIG. 2 is a block diagram of the example printer 100, the example waste ink collection apparatus 102, and the waste ink collection container 104 of FIG. 1. The example printer 100 includes the waste ink collection apparatus 102 and the print head(s) 110. The waste ink collection apparatus 102 is coupled to the waste ink collection container 104 via a valve 204. The example waste ink collection apparatus 102 includes an ink receptacle 206, an aerosol filter 208, a vacuum source 210, and the cartridge receptacle 106.

The example ink receptacle 206 receives waste ink 214 ejected by the print head(s) 110. The print head(s) 110 may eject the waste ink 214 during, for example, a spit operation to clean and/or refresh the nozzles on the print head(s) 110. The waste ink 214 is generally in the form of droplets and aerosol. The droplets are larger drops of the waste ink 214 that dry out less quickly. The aerosol includes aerosol particles that may be of different relative sizes, but are generally smaller than the droplets and, thus, dry out more quickly than the droplets. When the waste ink dries, it may leave a residue that can build up and clog passageways such as the valve 204, the ink receptacle 206, and/or the aerosol filter 208. The example ink receptacle 206 directs the droplets of waste ink 214 to the waste ink collection container 104 via the valve 204. The ink receptacle 206 further causes at least a portion of the aerosol particles of waste ink 214 to form droplets, which also move to the waste ink collection container 104.

The vacuum source 210 generates a flow of air through the ink receptacle 206 to the vacuum source 210. In particular, the vacuum source 210 generates suction where the ink receptacle 206 receives the waste ink 214, thereby urging or causing droplets and aerosol particles of waste ink 214 into the ink receptacle 206 and reducing the waste ink 214 that settles on other parts of the printer 100 and/or escapes the printer 100. As described in more detail below, the vacuum source 210 increases the amount of waste ink 214 aerosol that forms into droplets, thereby increasing the collection of the waste ink 214.

Aerosol particles of waste ink 214 that do not move to the waste ink collection container 104 are filtered out of the airflow to the vacuum source 210 by the aerosol filter 208. The example aerosol filter 208 includes an open-cell foam filter through which the aerosol particles are drawn via the airflow. The aerosol filter 208 may function as an inertial separator and/or an inertial impactor by accelerating the ink aerosol particles through the open-cell foam and causing the ink aerosol particles to contact and accumulate within the open-cell foam. The aerosol filter 208 may drain the filtered waste ink 214 to a consumable print head cleaner, such as the print head cleaning cartridge 108 that may be removed and/or replaced. In some examples, the aerosol filter 208 further includes a fabric filter to collect the smaller aerosol particles that are not filtered by the open-cell foam. The airflow travels through the fabric filter to the vacuum source 210. Of course, other implementations of the aerosol filter 208 may be used.

The example valve 204 is a one-way valve such as a duckbill valve. The valve 204 allows the ink droplets received by the ink receptacle 206 to move into the waste ink collection container 104 but does not allow air to travel into the ink receptacle (e.g., from the waste ink collection container 104 or from outside the waste ink collection apparatus 102). In some examples, the ink receptacle 206 is oriented such that the waste ink 214 enters the ink receptacle 206 at the top and exits at the bottom and, thus, gravity (in addition to the vacuum source 210) urges or causes the ink droplets to flow into the waste ink collection container 104. In general, the droplets of waste ink 214 have a sufficient amount of fluid to avoid completely drying out prior to entering the waste ink collection container 104, and the aerosol particles of waste ink 214 flow into the aerosol filter 208 via the airflow from the vacuum source 210.

In some examples, the ink receptacle 206 is consumable and/or user-replaceable. For example, the airflow created by the vacuum source 210 may dry out a portion of the ink moving through the ink receptacle 206, which causes deposits of dried ink to build up. When the dried ink has accumulated, the performance of the ink receptacle 206 and/or the vacuum source 210 may degrade until the ink receptacle 206 is cleaned or replaced.

Figure 3:
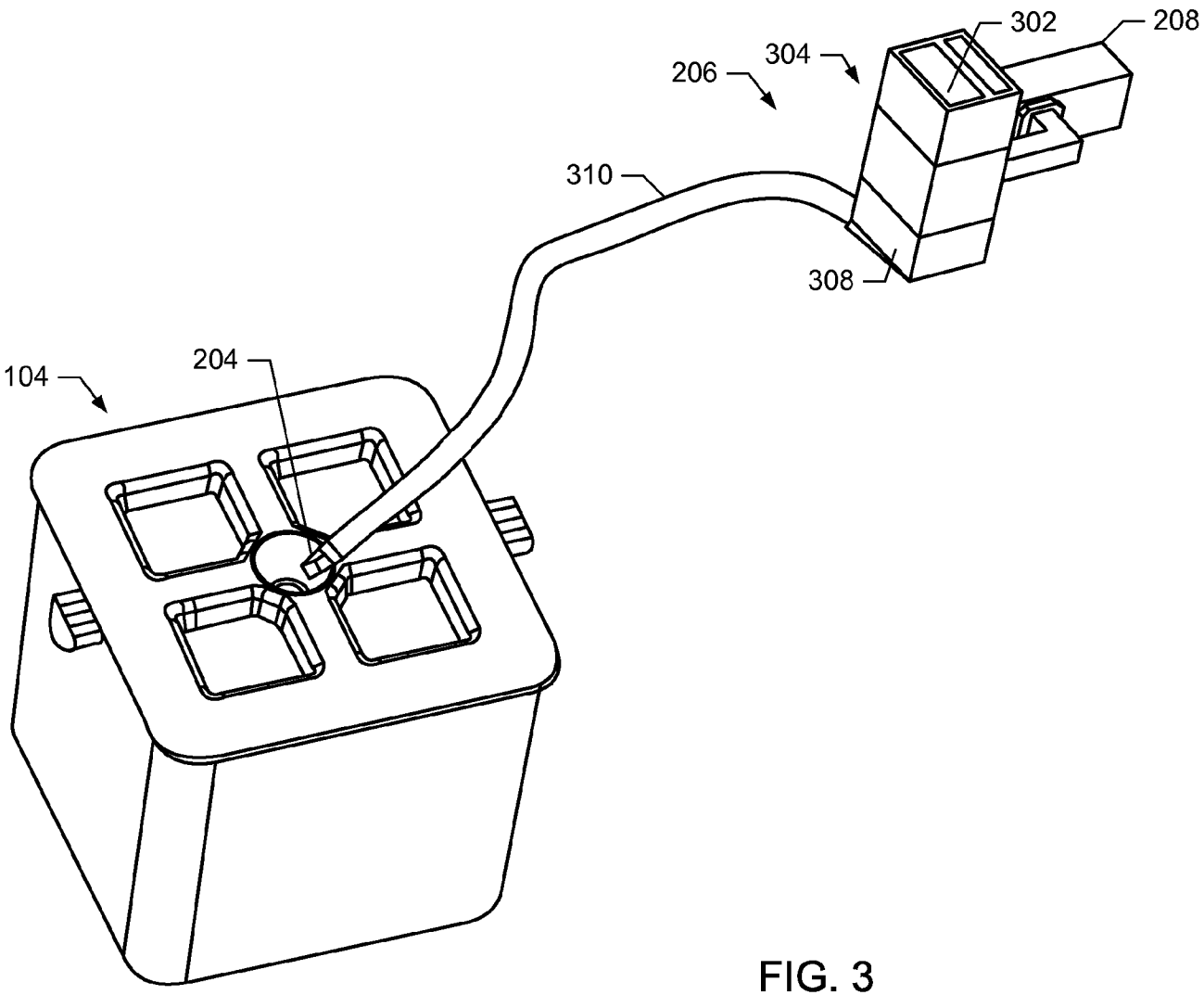
FIG. 3 illustrates one example of an ink receptacle and a waste ink collection container shown in the block diagram of FIG. 2.

FIG. 3 illustrates an example of an ink receptacle 206 and a waste ink collection container 104 shown in the block diagram of FIG. 2. As described above, the ink receptacle 206 receives the waste ink 214 from a print head 202 (FIG. 2).

The example ink receptacle 206 includes an opening 302, a separator 304 and a drain 308. In the illustrated example, the opening 302, the separator 304, and the drain 308 are arranged from the top to the bottom of the ink receptacle 206 as oriented in FIG. 3. The drain 308 is coupled to a drain tube 310 that directs the waste ink 214 from the drain 308 to the waste ink collection container 104. The end of the drain tube 310 opposite the drain 308 and adjacent the waste ink collection container 104 includes the valve 204. In the illustrated example, the valve 204 is a duckbill valve that allows ink to travel from the drain tube 310 to the waste ink collection container 104 but does not allow air to travel through the drain tube 310 to the ink receptacle 206. However, any appropriate type of one-way valve may be used instead to implement the valve 204.

Figure 4:
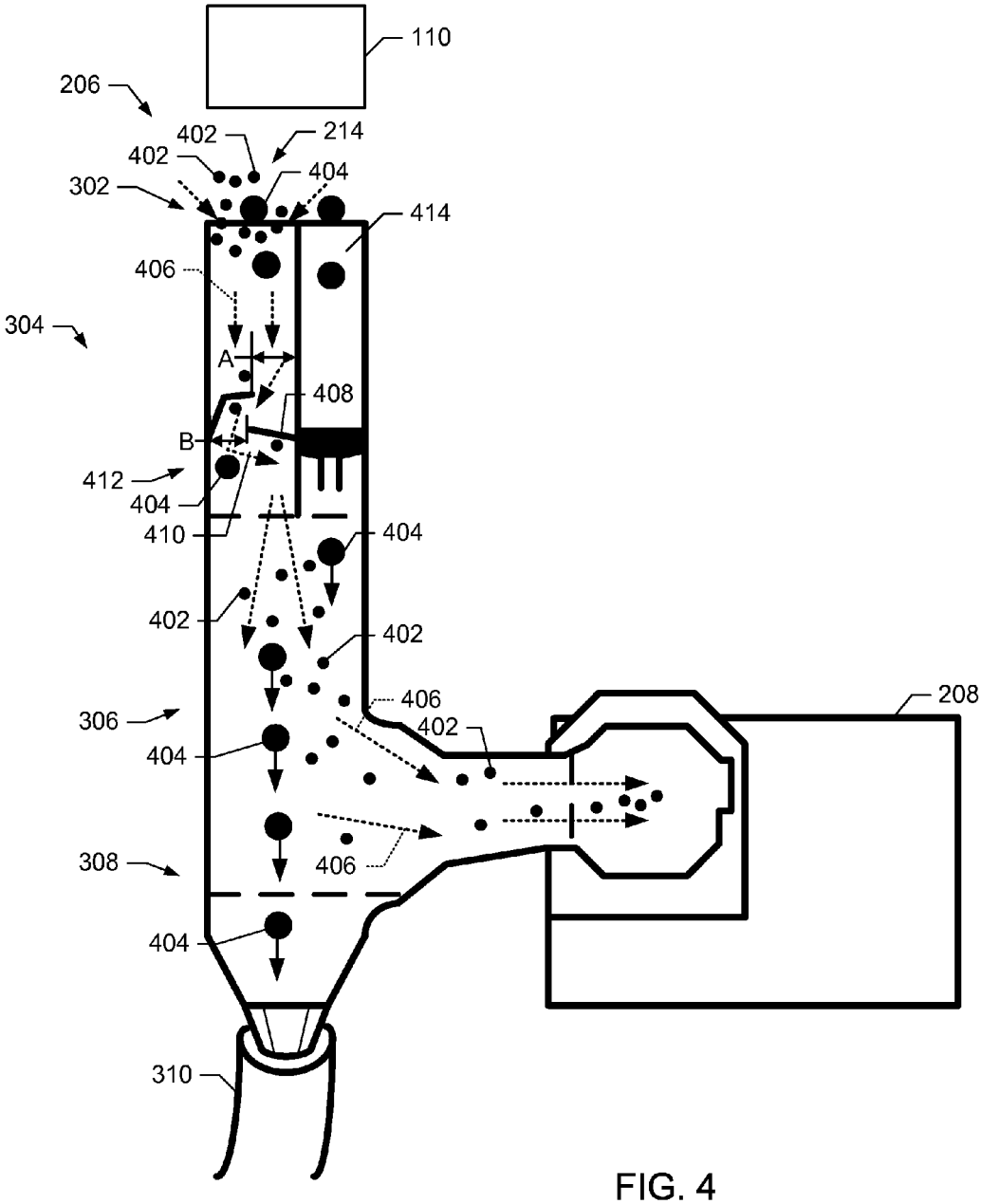
FIG. 4 is a more detailed view of the example ink receptacle of FIG. 3.

FIG. 4 is a more detailed view of the example ink receptacle 206 of FIG. 3. As discussed above, the example ink receptacle 206 includes an opening 302, the separator 304, and the drain 308. For purposes of discussion, the example waste ink 214 illustrated in FIG. 4 includes ink aerosol particles 402 (e.g., smaller, less massive particles) and ink droplets 404 (e.g., larger, more massive particles). Additionally, the illustrated example is oriented so that the waste ink 214 enters the opening 302 at the top of the ink receptacle 206. As illustrated in FIG. 4, the print head(s) 110 are positioned adjacent the ink receptacle 206 (e.g., for a spit operation).

In operation, the waste ink 214 enters the opening 302 after ejection from the print head(s) 110 and falls and/or is urged toward the separator 304 by an airflow 406, which may be caused by the vacuum source 210 of FIG. 2. The illustrated separator 304 includes at least two surfaces 408 and 410 that are arranged to form a tortuous path that imparts a sharp turn or directional change 412 to or otherwise obstruct or divert the airflow 406. In this particular example, the airflow 406 enters an opening of width A and the directional change is followed by another opening having a width of about B. In the illustrated example, A is about 6.7 millimeters (mm) and B is about 4 millimeters. As a result, at least some of the aerosol particles 402 that are carried in the airflow 406 impact the surfaces 408 and/or 410 and accumulate into ink droplets 404. Specifically, the airflow 406 accelerates the aerosol particles 402 to increase the inertia of the ink particles 402. If the inertia of an aerosol particle 402 is sufficiently high, the aerosol particle 402 cannot remain suspended in the airflow 406 as its direction changes and, thus, collides with the surface 408 or 410. As aerosol particles 402 collide with the surfaces 408 and 410, these particles 402 combine or coalesce into ink droplets 404.

The surfaces 408 and 410 may have any number of different geometries to cause the aerosol particles 402 to collide with the surfaces 408 and 410. Additionally, the example first separator 304 may have additional surfaces and/or features to impart sharp turns 412 or directional changes to the airflow 406 to cause the relatively smaller ink aerosol particles 402 to form ink droplets 404. The number and/or the geometries of the surfaces 408 and 410 and/or the sharp turn(s) 412 may be configured to avoid clogging of the separator 304 and/or may be configured to be consumable and to permit potential clogging of the separator 304 over time to collect more of the aerosol particles 402 in the separator 304 for storage in the waste ink collection container 104.

In the example of FIG. 4, the vacuum source 210 that generates the airflow 406 generates a pressure of about 18 mm-$H_2O$ and the airflow 406 has a velocity of about 1 to 1.3 meters per second (m/s) at the opening 302 of the ink receptacle 206. The example separator 304 increases the speed of the airflow 406 by a factor of about 3. Thus, the speed of the example airflow 406 at the sharp turn 412 is about 3-4 m/s. The example ink receptacle 206 and the sharp turn 412 may filter out ink particles larger than about 8 micrometers (μm). A large portion of the aerosol particles 402 that pass through the sharp turn 412 without combining or coalescing have a size of about 5 μm or less. The ink droplets 404 that are created by combining aerosol particles 402 and smaller ink droplets 404 and pass through the separator 304 are typically between about 15 μm and 20 μm in size.

After the airflow 406 exits the turn 412, the waste ink 214 (droplets 404 and ink aerosol particles 402) continue to flow downward (in the orientation of FIG. 4) with the airflow 406 induced by the vacuum source 210 and gravity. In particular, in an acceleration chamber 306, the ink droplets 404 are accelerated along with the ink aerosol particles 402 via the airflow 406. However, due to their mass and, thus, inertia, the ink droplets 404 fall into the drain 308 and through the tube 310 to the waste ink collection container 104. The aerosol particles 402, on the other hand, are carried by the airflow 406 through the acceleration chamber 306 to the aerosol filter 208.

In the example illustrated in FIG. 4, the ink receptacle 206 further includes a drop detector 414. The drop detector 414 also receives ink from the print head 202 during the spit operation, and the drop detector 414 determines whether ink is actually ejected from the print head(s) 110 during the spit operation. If the drop detector 414 fails to detect an ejection of the waste ink 214 from the print head 202, the drop detector 414 may determine that there is a problem with the print head that must be addressed and/or that the spit operation was not successful. The drop detector 414 may be implemented using any appropriate ink drop detection technique and/or device. As depicted in FIG. 4, the example drop detector 414 drains ink droplets into the acceleration chamber 306.

Figure 5:
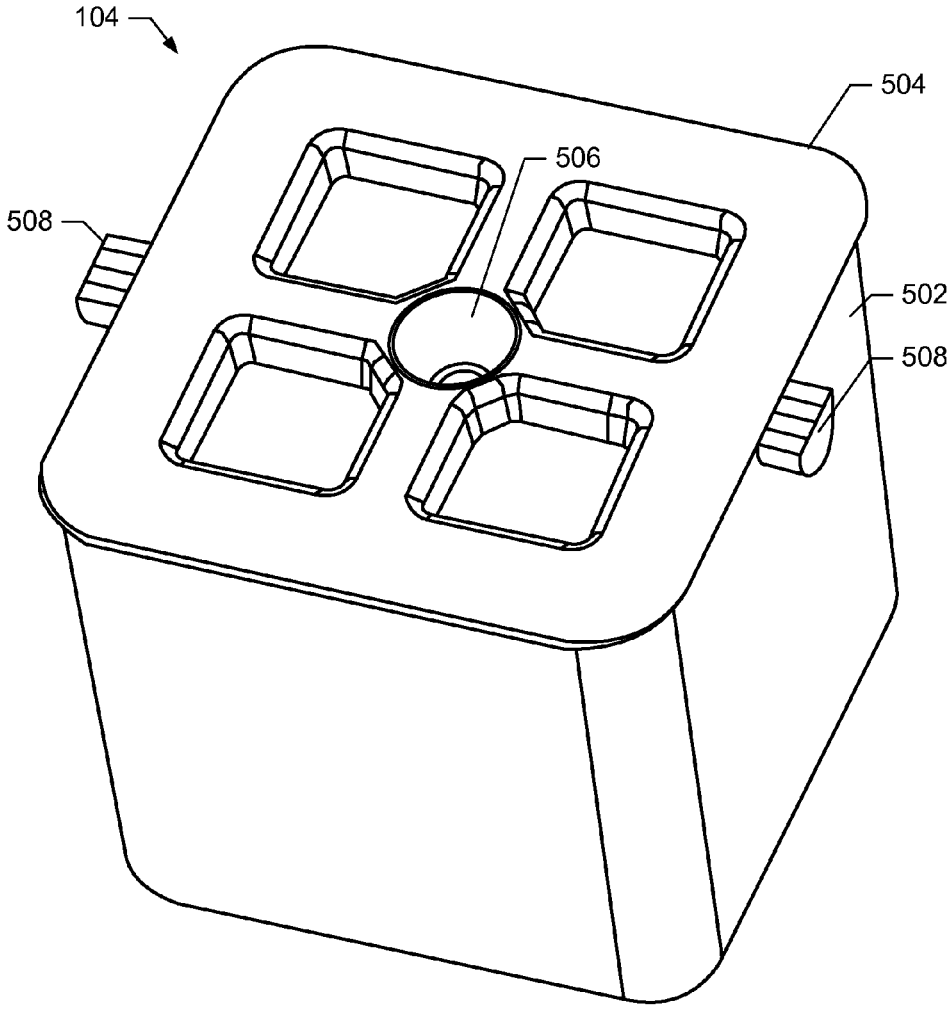
FIG. 5 is a more detailed external view of the example waste ink collection container of FIG. 3.

FIG. 5 is a more detailed outside view of the example waste ink collection container 104 of FIG. 3. The example waste ink collection container 104 is mounted to the outside of the example printer 100 or may be set on the floor. In contrast to many known waste ink collection containers, the example waste ink collection container 104 does not leak ink that has entered the container 104. For example, some known waste ink containers may spill ink when the container is tipped over. The example waste ink collection container 104 also reduces and/or prevents ink from clogging the inlet, thereby reducing and/or avoiding ink spills resulting from a clogged ink inlet.

The example waste ink collection container 104 of FIG. 5 includes a shell 502 and a cover 504. The example shell 502 and the example cover 504 are composed of Polyethylene terephthalate (PET). However, other materials may alternatively be used to implement the shell 502 and/or the cover 504. The shell 502 and the cover 504 are sealingly attached by, for example, welding, gluing, fastening, and/or any other appropriate method. The cover 504 includes an ink inlet 506, through which ink may enter the shell 502.

The example waste ink collection container 104 further includes handles 508 that may be used to mount the waste ink collection container 104 to the printer 100. In some examples, the handles 508 may be replaced or supplemented with a strap to hang the waste ink collection container 104 in an upright position (e.g., so that the ink inlet 506 is at the top of the waste ink collection container 104).

The example waste ink collection container 104 is simple to install in the printer 100 and simple to remove. Additionally, the ink inlet 506 does not need to be closed to reduce or prevent ink spillage, and can reduce or prevent ink spillage in any orientation. The spill-resistance of the example waste ink collection container 104 is not dependent on, for example, closing the cover 504 or sealing the cover 504 to the shell 502 prior to moving the waste ink collection container 104. Using the example shell 502 and the example cover 504 of FIG. 5, the waste ink collection container 104 may withstand a drop from at least 130 centimeters (cm) while full without breaking or spilling ink. In some examples, the waste ink collection container 104 may hold up to three liters of waste ink before the container 104 is full. In some examples, the separate waste ink collection container 104 and print head cleaning cartridge 108 may increase the useful life of the print head cleaning cartridge 108 by up to five times.

Figure 6A:
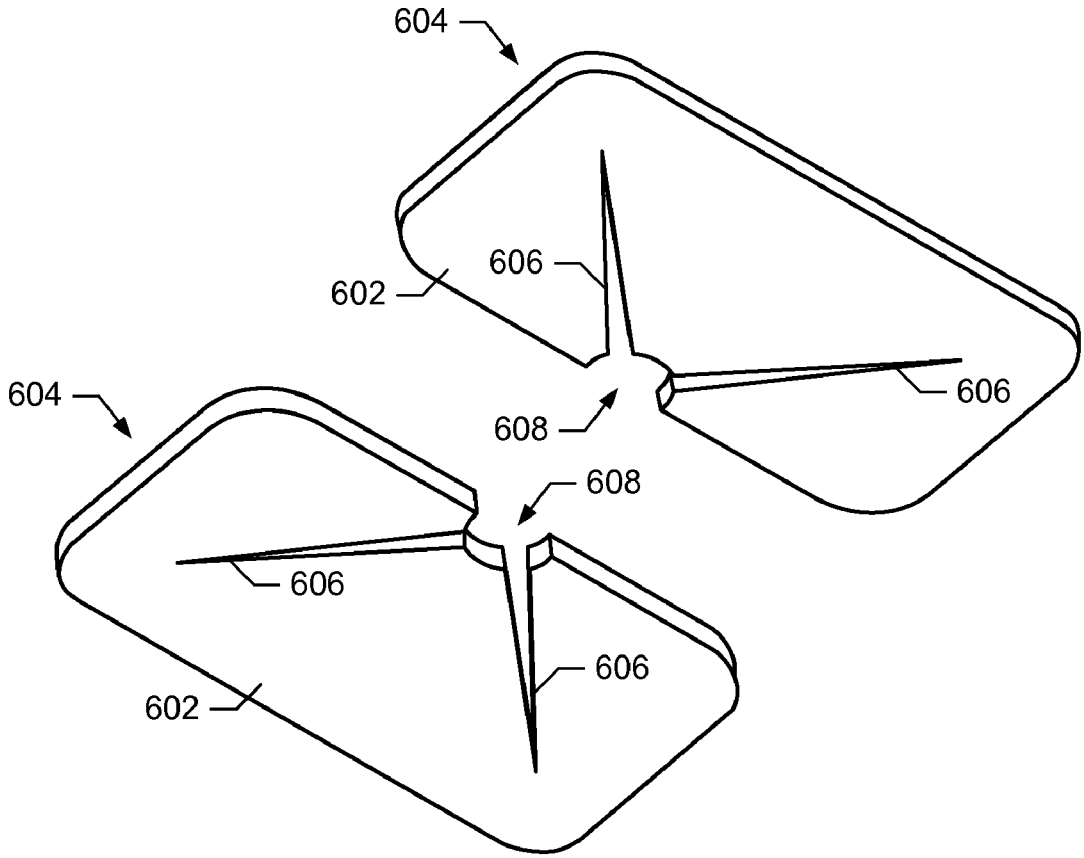
FIG. 6A illustrates an example configuration of absorbent material within the waste ink collection container of FIG. 5.

FIG. 6A illustrates an example configuration of absorbent material 602 that may be implemented within the waste ink collection container 104 of FIG. 5. The absorbent material 602 may be composed of polyurethane foam that absorbs ink. The example absorbent material 602 is formed into piles 604 or pads. However, the absorbent material 602 may alternatively be formed as a unitary or one-piece structure that substantially conforms to the inside of the shell (e.g., the shell 502 of FIG. 5). While the example piles 604 are currently more easily manufactured, a one-piece structure may reduce the amount of free ink (i.e., ink within the waste ink collection container 104 that is not absorbed by the absorbent material 602) within the waste ink collection container 104. The piles 604 may be formed into any appropriate thickness and/or geometry to fit a particular geometry of the shell 502.

The example piles 604 illustrated in FIG. 6 include capillaries 606 and an inlet gap 608. On each of the piles 604, the capillaries 606 extend from the inlet gap 608 toward the corners of the piles 604. The capillaries 606 provide a path for free ink to travel from more-saturated portions of the piles 604 (e.g., near the inlet gap 608) to less-saturated portions of the piles 604 to increase absorption of ink by the absorbent material 602. The inlet gap 608 accommodates an inlet (e.g., the inlet 506 of FIG. 5) that extends into the shell 502 from the cover 504.

Figure 6B:
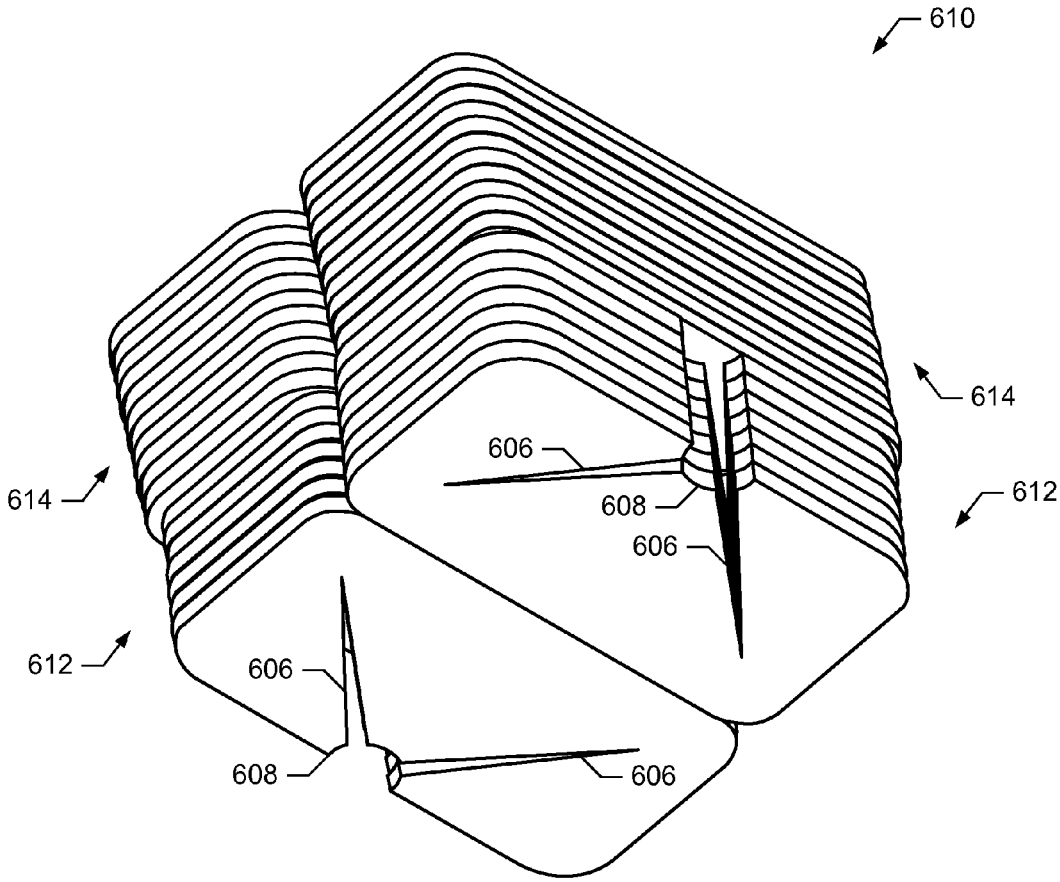
FIGS. 6B and 6C illustrate an example configuration of the absorbent materials of FIG. 6A within the example shell and the example cover of FIG. 5.
Figure 6C:
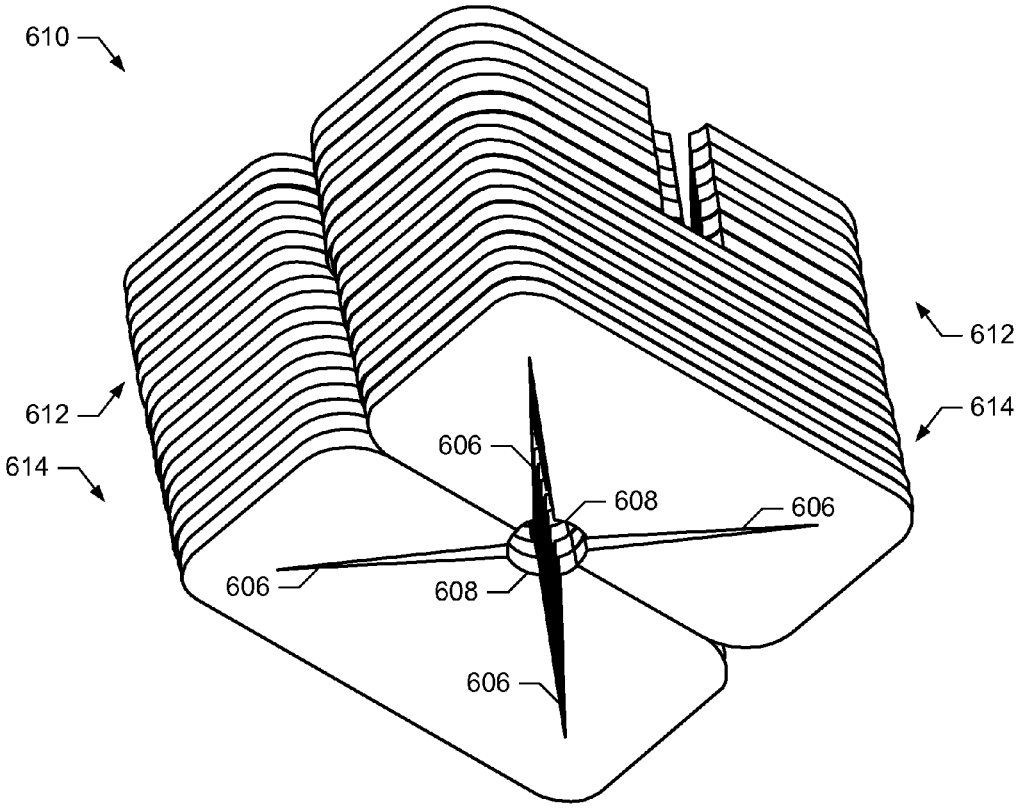

FIG. 6B illustrates an example configuration 610 of the absorbent materials 602 of FIG. 6A within the example shell 502 and the example cover 504 of FIG. 5. As shown in FIG. 6B, a first set 612 of piles 604 is arranged where the inlet gaps 608 are adjacent the outside of the configuration. A second set 614 of piles 604 is arranged where the inlet gaps 608 are located in the center of the configuration 610. Using the example shell 502 and the example cover 504 of FIG. 5, the configuration 610 is arranged within the shell 502 such that the first set 612 of piles 604 is opposite the cover 504 and the second set 614 of piles 604 is adjacent the cover 504. FIG. 6C is another view of the example configuration 610 illustrated in FIG. 6B. The view of FIG. 6C illustrates the arrangement of the second set 614 of piles 604.

Figure 7:
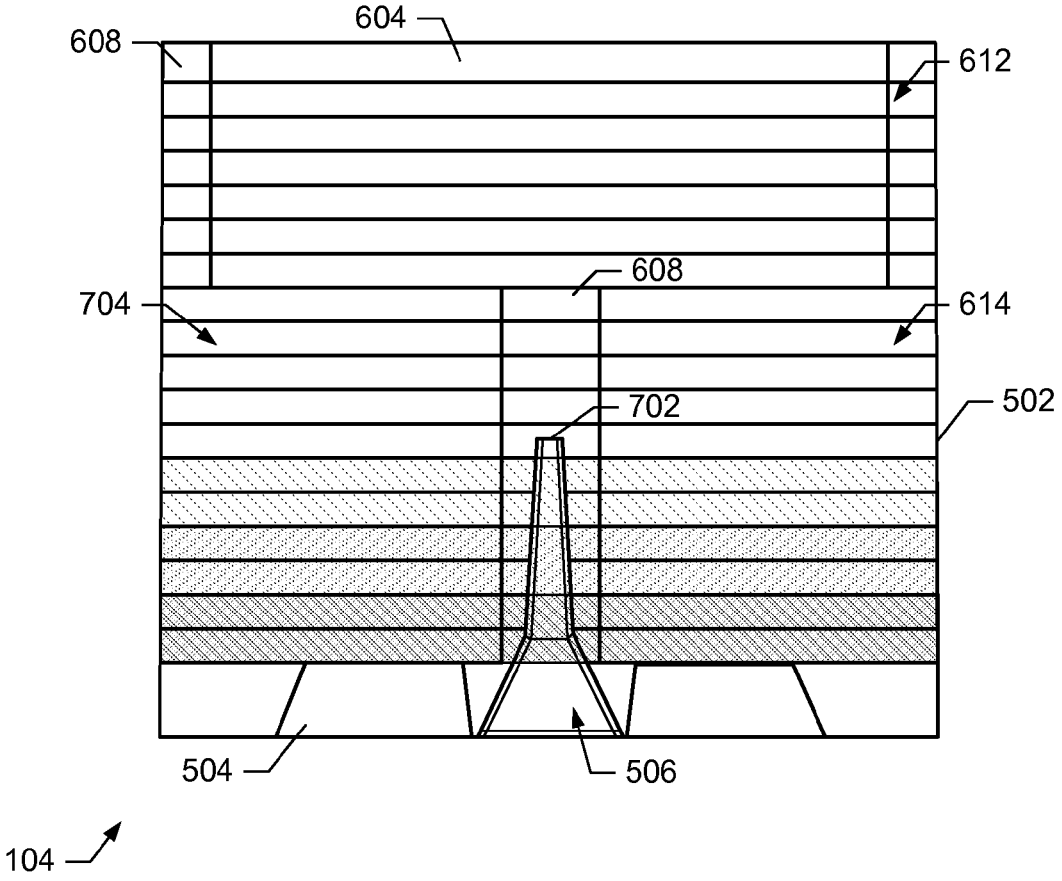
FIG. 7 illustrates an example ink response when the waste ink collection container of FIG. 5 is turned upside-down.

FIG. 7 illustrates an example ink response when the waste ink collection container 104 of FIG. 5 is turned upside-down. In contrast to many known ink storage containers, the example waste ink collection container 104 does not leak stored ink, even in the upside-down position. As illustrated in FIG. 7, the ink inlet (e.g., the inlet 506 of FIG. 5) includes a tapered pipe 702 extending from the cover 504 to a location within the shell 502. In particular, the example inlet 506 extends through the inlet gaps 608 of the second set 614 of piles 604. However, the inlet gaps 608 extend farther than the end of the tapered pipe 702, which creates a gap 704 so that ink does not clog the tapered pipe 702. In particular, when the waste ink collection container 104 fills at slower rates, the gap 704 helps prevent ink foam or ink bubbles from drying out immediately adjacent the tapered pipe 702, which could clog the tapered pipe 702 and potentially cause an ink spill.

When the waste ink collection container 104 is turned upside-down, the ink travels through the piles 604 and around the tapered pipe 702. Because the tapered pipe 702 extends into the shell 502, the ink settles below the opening of the tapered pipe 702. The cover 504 is sealed to the shell 502, so the ink cannot escape the waste ink collection container 104 through the cover 504. The inlet 506 and the tapered pipe 702 may be placed in other positions with respect to the shell 502 and the cover 504. In such examples, the piles 604 may have different inlet gap(s) 608. However, the tapered pipe 702 generally extends to a position within the shell to prevent leaking of ink through the tapered pipe 702 in any position.

The foregoing description, therefore, should not be construed to limit the scope of the disclosure, which is defined in the claims that follow the description.

The example methods and apparatus described above were developed in an effort to improve the performance of print head servicing in an inkjet printer and to reduce the costs associated with maintaining the print heads. Thus, embodiments of the disclosure are described with reference to print head servicing for an inkjet printer. As noted at the beginning of this Description, the examples shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. An ink separator, comprising:

an ink receptacle to receive ink aerosol particles;

a surface within the ink receptacle to change a direction of an airflow entraining the ink aerosol particles and cause at least a portion of the ink aerosol particles to combine to form ink droplets on the surface; and a chamber adjacent the surface to receive the airflow including the ink droplets and at least some of the ink aerosol particles, wherein the chamber includes at least two flow paths to separate the airflow and the ink aerosol particles from the ink droplets by directing the airflow and the ink aerosol particles to an aerosol collection port and the ink droplets to an ink droplet collection port.

2. An ink separator as defined in claim 1, further comprising an aerosol filter in communication with the aerosol collection port to filter at least a portion of the ink aerosol particles from the airflow.

3. An ink separator as defined in claim 1, wherein the ink receptacle is user-replaceable.

4. An ink separator as defined in claim 1, further comprising a vacuum source coupled to the aerosol collection port to generate the airflow.

5. An ink separator as defined in claim 1, wherein the ink droplets fall from the surface to a droplet collection opening adjacent the ink droplet collection port.

6. An ink separator as defined in claim 5, wherein the airflow urges the ink droplets from the surface to the droplet collection opening.

7. An ink separator as defined in claim 5, further comprising an ink collection container external to the ink receptacle to receive the ink droplets from the droplet collection opening.

8. An ink separator as defined in claim 7, wherein the ink collection container comprises:

a shell;

an absorbent material disposed within the shell; and an ink inlet having a tapered pipe extending from the shell to a location within the shell such that ink does not leak from the ink collection container regardless of the orientation of the ink collection container.

9. An ink separator as defined in claim 8, further comprising a tube coupled to the droplet collection opening and a one-way valve coupled to the tube opposite the droplet collection opening, the one-way valve to direct ink into the ink collection container.

10. An ink separator as defined in claim 9, wherein the one-way valve comprises a duckbill valve.

11. An ink separator, comprising:

an ink receptacle to receive ink aerosol particles;

a plurality of surfaces to redirect and accelerate an airflow entraining the ink aerosol particles to cause at least a portion of the ink aerosol particles to contact one or more of the surfaces to form ink droplets; and a chamber to receive the ink droplets, the airflow, and ink aerosol particles entrained in the airflow, to separate the ink droplets from the airflow, and to urge the ink droplets toward an ink collection container.

12. An ink separator as defined in claim 11, wherein the ink collection container comprises:

a shell;

an absorbent material disposed within the shell; and an ink inlet having a tapered pipe extending from the shell to a location within the shell such that ink does not leak from the ink collection container regardless of the orientation of the ink collection container.

13. An ink separator as defined in claim 11, wherein separating the ink droplets from the airflow comprises allowing the ink droplets to fall from the surfaces.

14. An ink separator as defined in claim 11, wherein the chamber is in communication with the ink collection container via a one-way valve.

15. An ink separator as defined in claim 11, wherein the chamber is to change a direction of the airflow to separate the ink droplets from the airflow.

16. An ink separator, comprising:

an ink receptacle to receive ink aerosol particles;

a separator to cause at least a portion of the ink aerosol particles to form ink droplets via inertial impaction; and a chamber to receive the ink droplets and ink aerosol particles entrained in an airflow and to direct the ink aerosol particles to an aerosol collection port and the ink droplets to a droplet collection port.

17. An ink separator as defined in claim 16, wherein the droplet collection port is positioned below the separator.

18. An ink separator as defined in claim 16, wherein the aerosol collection port is positioned above the droplet collection port.

19. An ink separator as defined in claim 16, further comprising an ink collection container external to the ink receptacle to receive the ink droplets from the droplet collection port.

20. An ink separator as defined in claim 16, further comprising a vacuum source to generate the airflow from the ink receptacle to the separator, the chamber, and the aerosol collection port.

* * * * *